US009164454B2

(12) United States Patent
Shimba et al.

(10) Patent No.: US 9,164,454 B2
(45) Date of Patent: Oct. 20, 2015

(54) IMAGE FORMING APPARATUS FOR PERFORMING REGISTRATION AND DENSITY CORRECTION CONTROL

(71) Applicant: CANON KABUSHIKI KAISHA, Tokyo (JP)

(72) Inventors: Takeshi Shimba, Kawasaki (JP); Ken Nakagawa, Yokohama (JP); Shinri Watanabe, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

(21) Appl. No.: 13/868,557

(22) Filed: Apr. 23, 2013

(65) Prior Publication Data

US 2013/0302051 A1 Nov. 14, 2013

(30) Foreign Application Priority Data

May 11, 2012 (JP) ..... 2012-109933

(51) Int. Cl.
*G03G 15/00* (2006.01)
*G03G 15/01* (2006.01)

(52) U.S. Cl.
CPC ..... *G03G 15/5041* (2013.01); *G03G 15/0189* (2013.01); *G03G 15/5025* (2013.01); *G03G 15/5058* (2013.01); *G03G 2215/0161* (2013.01); *G03G 2215/0164* (2013.01)

(58) Field of Classification Search
CPC ..... G03G 15/5041; G03G 15/5058; G03G 15/556; G03G 2215/0161; G03G 2215/00037; G03G 2215/00042; G03G 2215/00046
USPC ..... 399/49, 74, 301
See application file for complete search history.

(56) References Cited

U.S. PATENT DOCUMENTS 6,381,435 B2 4/2002 Shinohara et al.
6,731,889 B2 * 5/2004 Nakayama ..... 399/49

(Continued)

FOREIGN PATENT DOCUMENTS

CN 1403884 A 3/2003
CN 102158627 A 8/2011

(Continued)

OTHER PUBLICATIONS

Office Action dated Jul. 5, 2013, in Japanese Application No. 2012-109933.

(Continued)

*Primary Examiner* — David Gray
*Assistant Examiner* — Carla Therrien
(74) *Attorney, Agent, or Firm* — Fitzpatrick, Cella, Harper & Scinto

(57) ABSTRACT

An image forming apparatus includes a forming unit configured to continuously form, on an image carrier, first and second detection patterns for detecting relative registration amounts and a density of each of a plurality of colors; and a control unit configured to control registration and the density. The forming unit forms the detection patterns such that a leading edge developer color of a detection pattern formed on a front side among the two detection patterns, in a direction in which the detection patterns are moved by rotation of the image carrier, is the same as a trailing edge developer color of the detection pattern formed on the front side, or a leading or trailing edge developer color of a detection pattern formed on a rear side among the two detection patterns.

16 Claims, 9 Drawing Sheets

(56) References Cited

U.S. PATENT DOCUMENTS

| | | | | |
|---|---|---|---|---|
| 7,020,404 | B2 | 3/2006 | Fukuda et al. | |
| 7,190,912 | B2 * | 3/2007 | Kato | 399/49 |
| 7,228,083 | B2 * | 6/2007 | Iwakawa | 399/49 |
| 7,315,378 | B2 | 1/2008 | Phelan et al. | |
| 7,653,332 | B2 * | 1/2010 | Ehara et al. | 399/167 |
| 8,150,292 | B2 * | 4/2012 | Ohashi | 399/92 |
| 8,260,164 | B2 * | 9/2012 | Masuda | 399/49 |
| 8,509,634 | B2 | 8/2013 | Saida | |
| 8,587,627 | B2 * | 11/2013 | Takahashi et al. | 347/234 |
| 8,639,134 | B2 | 1/2014 | Saida | |
| 8,665,492 | B2 * | 3/2014 | Toriyabe | 358/1.9 |
| 8,787,782 | B2 * | 7/2014 | Masuda | 399/49 |
| 2009/0080915 | A1 * | 3/2009 | Hashimoto | 399/39 |
| 2010/0098452 | A1 * | 4/2010 | Inaba | 399/92 |
| 2010/0266302 | A1 * | 10/2010 | Suzuki et al. | 399/49 |
| 2011/0044713 | A1 * | 2/2011 | Masuda et al. | 399/74 |
| 2011/0176155 | A1 * | 7/2011 | Toriyabe | 358/1.9 |
| 2011/0243588 | A1 | 10/2011 | Saida | |
| 2011/0280595 | A1 | 11/2011 | Naito | |
| 2011/0280599 | A1 * | 11/2011 | Ino et al. | 399/44 |
| 2011/0280605 | A1 * | 11/2011 | Kishi | 399/49 |
| 2012/0288297 | A1 * | 11/2012 | Sugeta et al. | 399/72 |
| 2013/0022377 | A1 * | 1/2013 | Sugeta et al. | 399/301 |
| 2013/0156472 | A1 | 6/2013 | Watanabe | |
| 2013/0243458 | A1 * | 9/2013 | Suzuki et al. | 399/49 |
| 2013/0251389 | A1 * | 9/2013 | Suzuki et al. | 399/49 |
| 2013/0272740 | A1 * | 10/2013 | Nakagawa et al. | 399/74 |
| 2013/0302048 | A1 * | 11/2013 | Sekiguchi et al. | 399/49 |
| 2013/0302049 | A1 * | 11/2013 | Nakagawa et al. | 399/49 |
| 2013/0302050 | A1 * | 11/2013 | Shimba et al. | 399/49 |
| 2013/0330108 | A1 * | 12/2013 | Watanabe | 399/301 |

FOREIGN PATENT DOCUMENTS

| | | | |
|---|---|---|---|
| CN | 102213928 | A | 10/2011 |
| CN | 102253625 | A | 11/2011 |
| EP | 2 388 652 | A2 | 11/2011 |
| EP | 2 525 261 | A2 | 11/2012 |
| JP | 1-167769 | A | 7/1989 |
| JP | 11-143171 | A | 5/1999 |
| JP | 2001-166553 | A | 6/2001 |
| JP | 2003-186278 | A | 7/2003 |
| JP | 2004-110018 | A | 4/2004 |
| JP | 2004-188665 | A | 7/2004 |
| JP | 2004-252172 | A | 9/2004 |
| JP | 2004-252321 | A | 9/2004 |
| JP | 2004-361406 | A | 12/2004 |
| JP | 2006-208266 | A | 8/2006 |
| JP | 2006-251652 | A | 9/2006 |
| JP | 2006-267644 | A | 10/2006 |
| JP | 2006-284892 | A | 10/2006 |
| JP | 2007-10744 | A | 1/2007 |
| JP | 2008-185914 | A | 8/2008 |
| JP | 2008-261864 | A | 10/2008 |
| JP | 2009-150690 | A | 7/2009 |
| JP | 2010-097209 | A | 4/2010 |
| JP | 2010-117735 | A | 5/2010 |
| JP | 2012-42884 | A | 3/2012 |

OTHER PUBLICATIONS

Communication dated Dec. 17, 2013, forwarding a European Search Report dated Dec. 6, 2013, in European Application No. 13165304.0-1560.

Office Action in Chinese Patent Application No. 201310172360.5, dated Jun. 3, 2015.

* cited by examiner

IMAGE FORMING APPARATUS FOR PERFORMING REGISTRATION AND DENSITY CORRECTION CONTROL

BACKGROUND OF THE INVENTION

1. Field of the Invention

The present invention principally relates to an image forming apparatus such as an electrophotographic type or electrostatic printing type copying machine or printer. In particular, the present invention relates to the detection control of the tint and positions of developer images of colors formed in an image forming apparatus.

2. Description of the Related Art

In a color image forming apparatus including a plurality of photosensitive members, misregistration occurs between images of different colors due to, e.g., mechanical mounting errors of the photosensitive members, or optical path length differences or optical path changes of laser beams of different colors. Also, the image density for each color fluctuates due to various conditions such as the usage environment and the number of copies, therefore, the color balance, that is, the tint changes.

In an image forming apparatus, therefore, registration correction and density correction are performed between images of different colors. Japanese Patent Laid-Open No. 11-143171 has proposed a method of detecting and correcting misregistration and detecting and correcting densities by forming a registration detection pattern and density detection pattern on an intermediate transfer belt. Japanese Patent Laid-Open No. 11-143171 avoids increases in size and cost of the apparatus by detecting the registration and density detection patterns by using the same sensor.

Also, Japanese Patent Laid-Open No. 2001-166553 has disclosed a method of forming both registration and density detection patterns on an intermediate transfer belt, and correcting the misregistration and densities by the same sequence, thereby shortening the time required for the correction.

In the related art, the correction control time is shortened by correcting the misregistration and densities by the same sequence. In this method, a plurality of registration detection patterns and a plurality of density detection patterns may be repetitively formed on an intermediate transfer belt, in order to avoid the influence of periodical variations generated by the rotation periods of, for example, photosensitive members or rollers for driving the intermediate transfer belt, because the photosensitive members or rollers are off-centered. To correct misregistration and densities by the same sequence, the detection patterns must be formed within one circumference of the intermediate transfer belt. As image forming apparatuses have been downsized recently, however, the circumference of the intermediate transfer belt shortens. Accordingly, demands have arisen for accurately correcting misregistration and densities even with a short pattern length.

SUMMARY OF THE INVENTION

The present invention provides an image forming apparatus for accurately correcting misregistration and densities by using short detection patterns.

According to an aspect of the present invention, an image forming apparatus includes: a forming unit configured to continuously form, on an image carrier, a first detection pattern for detecting relative misregistration amounts of developer images of a plurality of colors, and a second detection pattern for detecting a density of each of the plurality of colors; and a control unit configured to control registration in accordance with a detection result of the first detection pattern and control the density in accordance with a detection result of the second detection pattern. The forming unit forms the detection patterns such that a leading edge developer color of a detection pattern formed on a front side among the two detection patterns, in a direction in which the detection patterns are moved by rotation of the image carrier, is the same as a trailing edge developer color of the detection pattern formed on the front side, or a leading or trailing edge developer color of a detection pattern formed on a rear side among the two detection patterns.

Further features of the present invention will become apparent from the following description of exemplary embodiments with reference to the attached drawings.

DESCRIPTION OF THE EMBODIMENTS

Exemplary embodiments of the present invention will be explained below with reference to the accompanying drawings. Note that constituent elements unnecessary for explaining the embodiments will be omitted from each drawing.

First Embodiment

Figure 1:
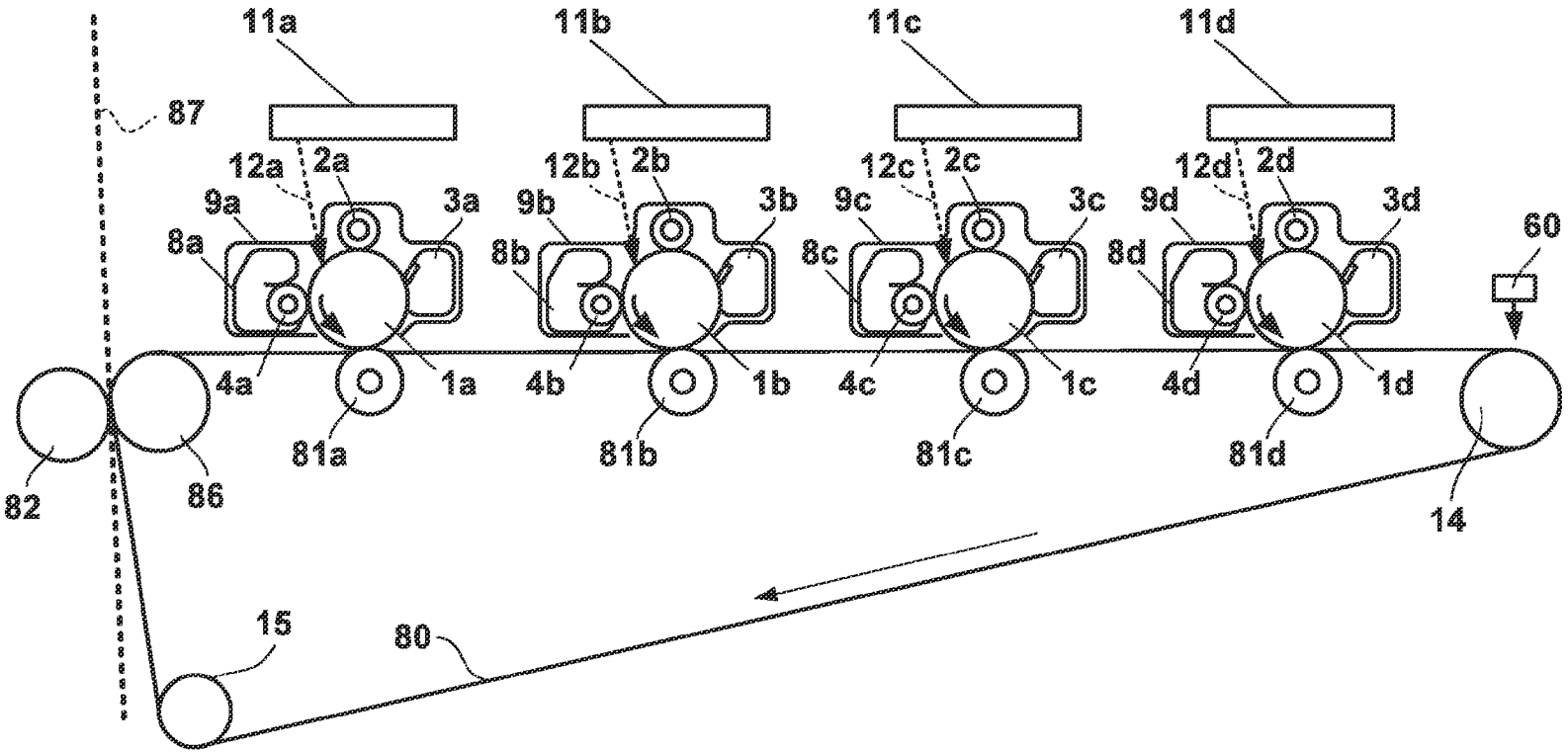
FIG. 1 is a view showing the arrangement of an image forming unit of an image forming apparatus according to an embodiment.

FIG. 1 is a view showing the arrangement of an image forming unit of an image forming apparatus of this embodiment. In FIG. 1, constituent elements denoted by reference numerals suffixed by characters a, b, c, and d are respectively the constituent elements of first, second, third, and fourth stations. Note that in this embodiment, the first, second, third, and fourth stations are image forming stations for forming toner images as developer images of yellow (Y), magenta (M), cyan (C), and black (K), respectively, on an intermediate transfer belt 80 as an image carrier. Note also that the first to fourth stations have the same arrangement except for the colors of toners as developers, so reference numerals not suffixed by the characters a, b, c, and d will be used in the following explanation when it is unnecessary to distinguish between the colors.

A charging roller 2 is contact with a photosensitive member 1 rotating in a direction indicated by the arrow, and charges the surface of the photosensitive member 1 to negative polarity. An exposure unit 11 scans the photosensitive member 1 with a scanning beam 12 modulated based on an image signal, thereby forming an electrostatic latent image on the photosensitive member 1. A developing unit 8 contains toner of a corresponding color, and develops the electrostatic latent image on the photosensitive member 1 with the toner by using a developing bias applied to a developing roller 4, thereby forming a toner image. A primary transfer roller 81 applies a DC bias having polarity (positive polarity) opposite to that of the toner, thereby transferring the toner image on the corresponding photosensitive member 1 to the intermediate transfer belt 80. In addition, a cleaning unit 3 removes the toner not transferred to the intermediate transfer belt 80 and remaining on the photosensitive member 1. In this embodiment, the photosensitive member 1, developing unit 8, charging roller 2, and cleaning unit 3 form an integrated process cartridge 9 detachable from the image forming apparatus.

The intermediate transfer belt 80 is supported by three rollers, that is, a secondary transfer counter roller 86, driving roller 14, and tension roller 15 as extension members, and maintained at an appropriate tension. When the driving roller 14 is driven, the intermediate transfer belt 80 rotates in a direction indicated by the arrow and moves at almost the same speed in a forward direction with respect to the photosensitive member 1. The first to fourth stations transfer toner images of the individual colors to the intermediate transfer belt 80 by superimposing the images, thereby forming a color image on the intermediate transfer belt 80. This toner image formed on the intermediate transfer belt 80 is transferred to a printing material conveyed by a convey path 87 by a secondary transfer roller 82. After that, the toner image transferred to the printing material is fixed on it by a fixing unit (not shown). In this embodiment, a sensor unit 60 for registration correction and density correction is provided downstream of the fourth station above the intermediate transfer belt 80 in the conveyance direction.

Figure 2:
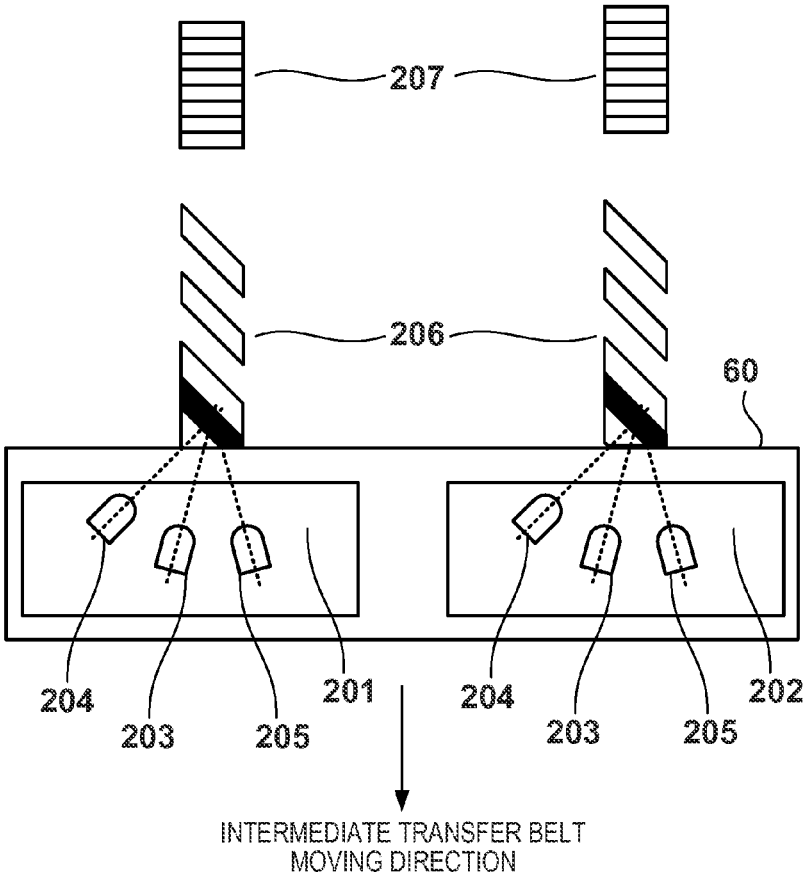
FIG. 2 is a view showing the arrangement of a registration correction/density correction sensor according to an embodiment.

FIG. 2 is a view showing the arrangement of the sensor unit 60 according to this embodiment. The sensor unit 60 of this embodiment includes two sensors 201 and 202 having the same arrangement. The sensor 201 detects a detection pattern formed in the vicinity of one end portion of the intermediate transfer belt 80 in a direction perpendicular to the moving direction of the surface. The sensor 202 detects a detection pattern formed in the vicinity of the other end portion of the intermediate transfer belt 80. Each of the sensors 201 and 202 includes a light-emitting element 203 for emitting light toward the intermediate transfer belt 80, and light-receiving elements 204 and 205 for receiving light emitted by the light-emitting element 203 and reflected by the surface of the intermediate transfer belt 80 or by the detection pattern formed on the surface. Note that the light-receiving element 204 receives diffuse reflection light reflected by the surface of the intermediate transfer belt 80 or the detection pattern, the light-receiving element 205 receives specular reflection light, and the light-receiving elements 204 and 205 each output a detection voltage corresponding to the received light amount. Although the two sensors are formed in FIG. 2, three or more sensors may also be formed. It is also possible to detect misregistration by using two or more sensors, and detect densities by using one or more sensors.

Figure 3A:
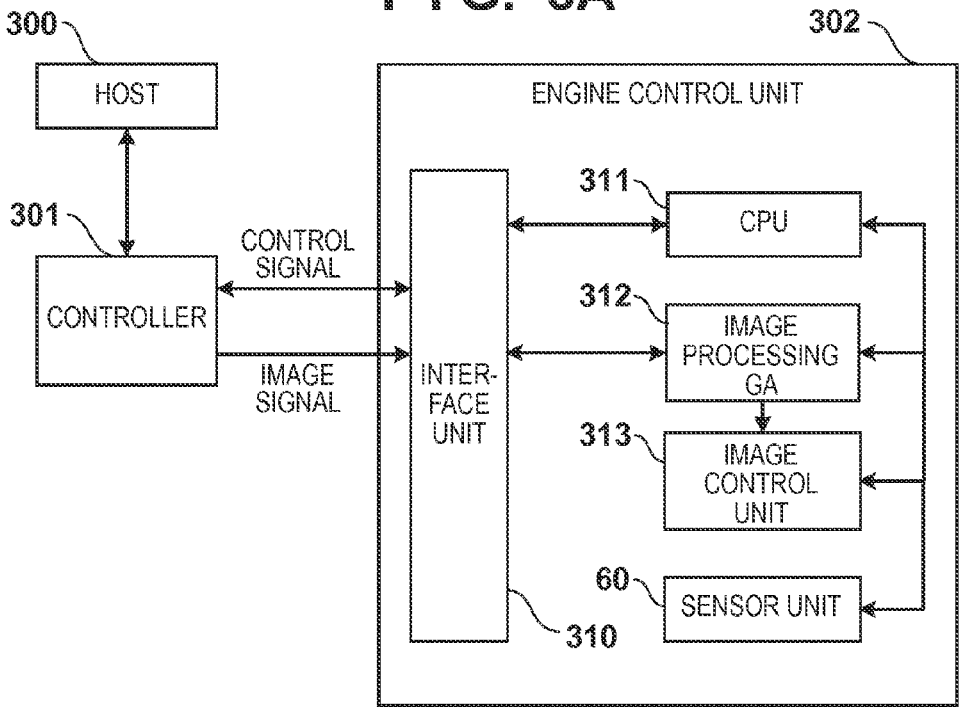
FIGS. 3A and 3B are views showing the arrangement of the image forming apparatus according to an embodiment.

FIG. 3A is a view showing the arrangement of the image forming apparatus according to this embodiment. As shown in FIG. 3A, a controller 301 can communicate with a host computer 300 and engine control unit 302. When executing registration and density correction control, the controller 301 outputs a correction control start command to the engine control unit 302. Upon receiving the correction control start command via an interface unit 310, a CPU 311 instructs an image control unit 313 to start correction control. When receiving the instruction to start correction control, the image control unit 313 controls the image forming unit shown in FIG. 1 to make preparations for forming detection patterns. After the preparations are complete, the CPU 311 requests the controller 301 to transmit an image signal corresponding to the detection patterns. In response to this request from the CPU 311, the controller 301 outputs the image signal to the engine control unit 302.

Upon receiving the image signal from the controller 301, an image processing GA 312 transmits image formation data to the image control unit 313. The image control unit 313 controls the image forming unit to form detection patterns on the intermediate transfer belt 80 based on the image formation data. After that, the CPU 311 obtains voltage values corresponding to the densities of the detection patterns from the sensor unit 60. Based on the detected voltage values obtained from the sensor unit 60, the CPU 311 calculates a density correction amount of the formed detection pattern for each color, and calculates a misregistration correction amount of the detection pattern for each color in each of a main scanning direction and sub-scanning direction. After that, the CPU 311 notifies the controller 301 of the calculated misregistration correction amounts and density correction amounts via the interface unit 310.

Figure 3B:
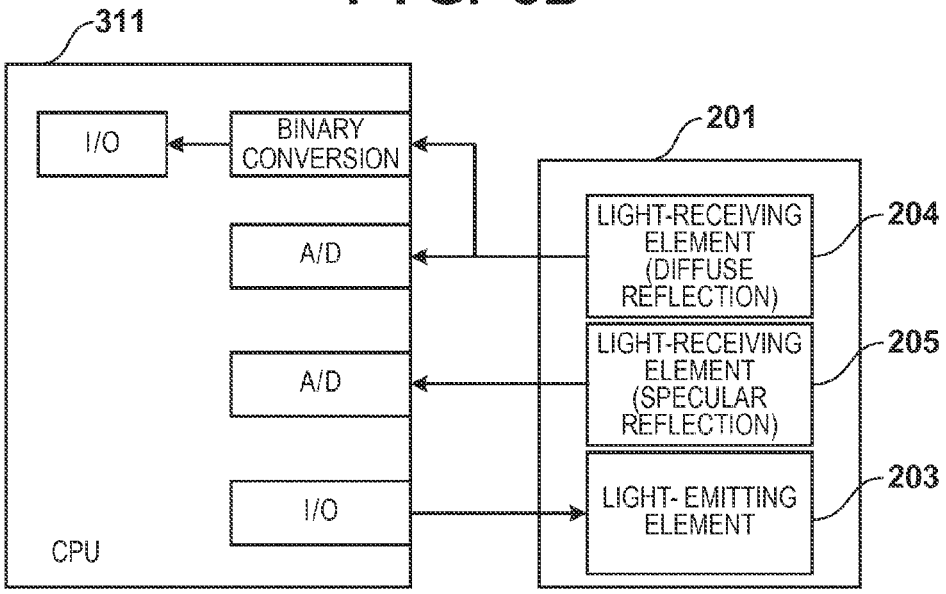

FIG. 3B shows the arrangement of the CPU 311 and the sensor 201 of the sensor unit 60 according to this embodiment. Note that the arrangement of the CPU 311 and sensor 202 is the same. The CPU 311 transmits a driving signal from an I/O port to the light-emitting element 203, thereby controlling the light emission amount of the light-emitting element 203. The light-receiving element 204 for diffuse reflection light outputs a signal corresponding to the received light amount to a binary conversion circuit and A/D port of the CPU 311. The binary conversion circuit binarizes the input voltage by using a comparator, and outputs the binary signal to the I/O port of the CPU 311. The CPU 311 detects the point of variation of the signal input to the I/O port, as the boundary between the colors of the detection patterns. The CPU 311 calculates a misregistration correction amount from the detected boundary. Also, the light-receiving element 205 for specular reflection light outputs a signal corresponding to the received light amount to an A/D port of the CPU 311. The A/D ports of the CPU 311 sample the input signals corresponding to the diffuse reflection light amount and specular reflection light amount, and save the sampled signals in a saving unit (not shown) connected to the CPU 311. The CPU 311 calculates a density correction amount from the signals input to the A/D ports and corresponding to the diffuse reflection light amount and specular reflection light amount.

Figure 4A:
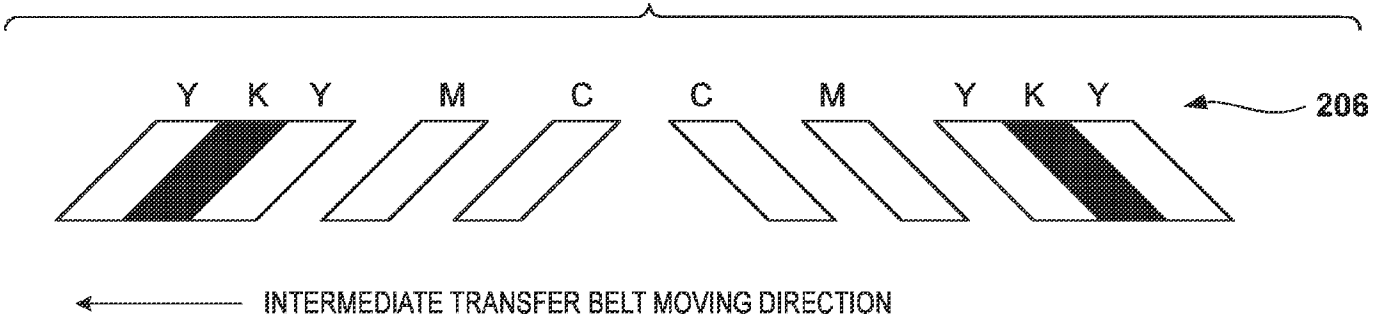
FIGS. 4A and 4B are views showing a registration detection pattern and density detection pattern according to an embodiment.
Figure 4B:
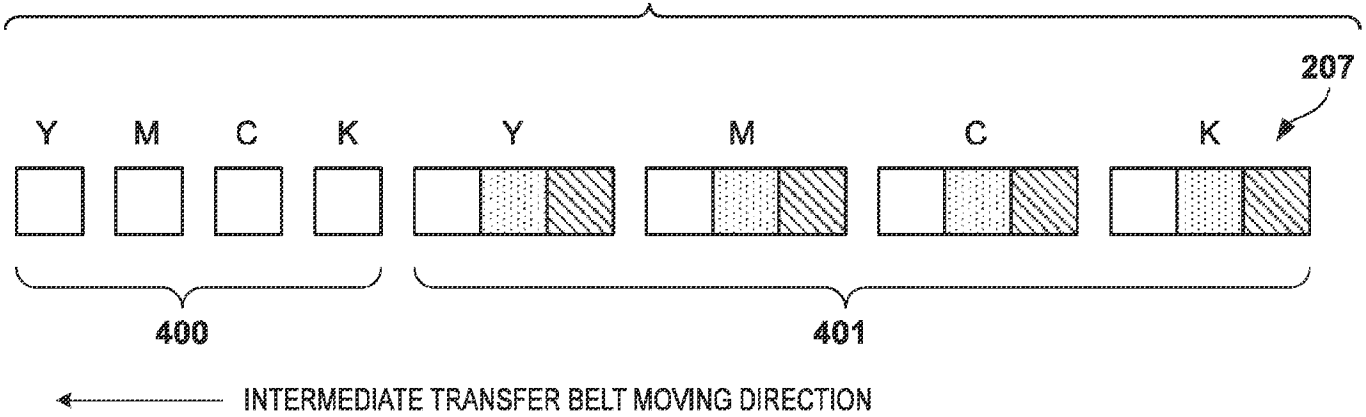

FIGS. 4A and 4B are views showing detection patterns according to this embodiment. FIG. 4A shows a registration detection pattern 206, and FIG. 4B shows a density detection pattern 207. As shown in FIG. 4A, the registration detection pattern 206 includes a detection pattern obtained by forming a patch image of black K on a patch image of yellow Y, and patch images of magenta (M) and cyan (C). Note that it is also possible to form a patch image of black on a patch image of magenta or cyan, instead of yellow. The density detection pattern 207 includes density measurement patches 401 for measuring the densities of the individual colors, and reference patches 400 of the individual colors to be used to measure the reflection characteristic of the sensor, and specify the positions of the density measurement patches 401 of the individual colors. Note that the density measurement patch 401 of each color is formed by using toner images having a plurality of densities. Note also that in the following explanation, the yellow, magenta, and cyan portions of the registration detection pattern 206 will be called color regions, and the black portion of the registration detection pattern 206 will be called a black region.

Figure 5B:
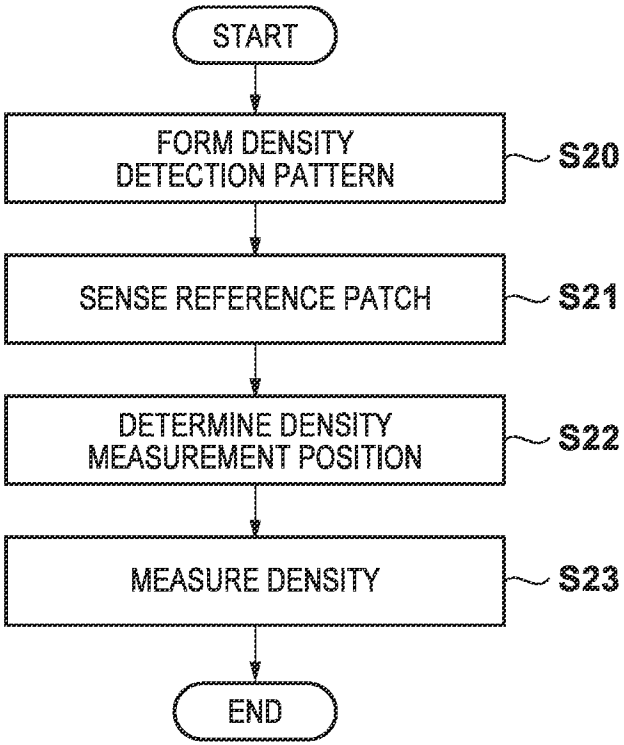
FIGS. 5A and 5B are flowcharts of correction control according to an embodiment.
Figure 5A:
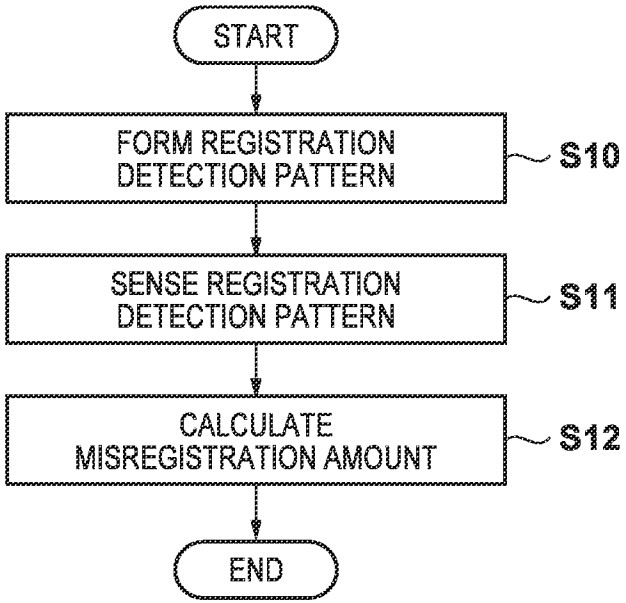

FIG. 5A is a flowchart of registration correction control. When registration correction control is started, the CPU 311 forms the registration detection pattern 206 shown in FIG. 4A on the intermediate transfer belt 80 in step S10. In step S11, the sensors 201 and 202 detect the formed registration detection pattern 206. In step S12, based on the detected position of the registration detection pattern 206, the CPU 311 calculates, with respect to the reference color, that is, yellow in FIG. 4A, the relative misregistration amounts of colors other than the reference color.

FIG. 5B is a flowchart of density correction control. When density correction control is started, the CPU 311 forms the density detection pattern 207 shown in FIG. 4B on the intermediate transfer belt 80 in step S20. In step S21, the CPU 311 detects the reference patches 400. In step S22, based on the detected positions of the reference patches 400 of the individual colors, the CPU 311 determines the density measurement positions of the density measurement patches 401 of the respective corresponding colors. Since the distance between the reference patch 400 and density measurement patch 401 of the same color is almost constant regardless of a misregistration amount from the reference color, the density can accurately be measured regardless of the misregistration amount by determining the density measurement position of the density measurement patch 401 based on the reference patch 400. In step S23, the CPU 311 measures the density of the density measurement patch 401 of each color by using the sampling value of reflection light in the determined density measurement position. Note that as will be described later, when performing registration correction control and density correction control by the same sequence, the registration detection pattern 206 and density detection pattern 207 are continuously formed and detected, and the correction amounts of the patterns are calculated.

Figure 6A:
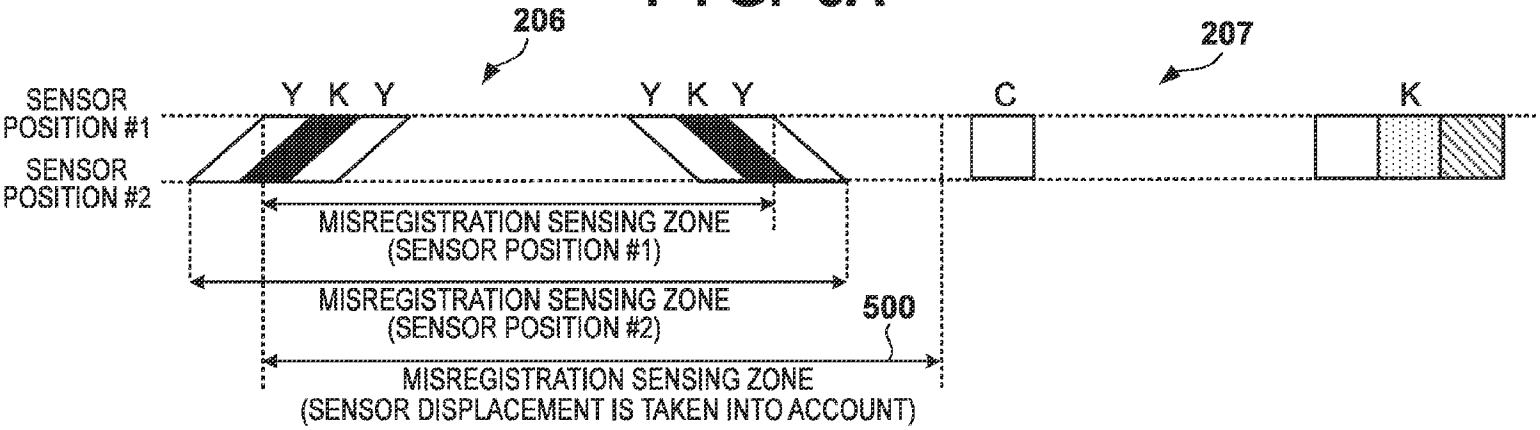
FIGS. 6A and 6B are views showing the layouts of the detection patterns according to an embodiment.
Figure 6B:
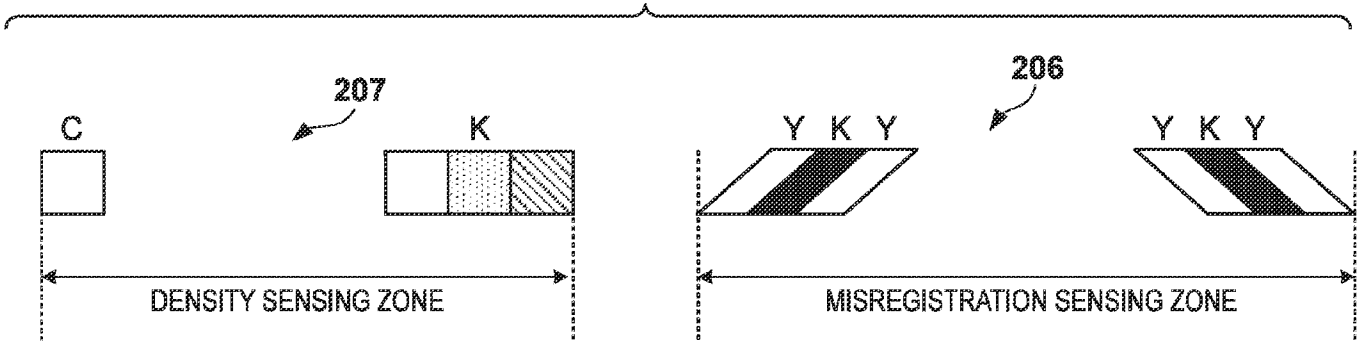

The order of the arrangement of the registration detection pattern 206 and density detection pattern 207 of this embodiment will be explained below with reference to FIGS. 6A and 6B. In FIG. 6A, the registration detection pattern 206 is positioned on the front side of the density detection pattern 207. In FIG. 6B, the density detection pattern 207 is positioned on the front side of the registration detection pattern 206. Note that in the following explanation, "the front side" is the downstream side in the moving direction of the surface of the intermediate transfer belt 80, that is, the side that reaches the sensing region of the sensor unit 60 earlier. On the other hand, "the rear side" is the upstream side in the moving direction of the intermediate transfer belt 80.

In the registration detection pattern 206, the patches of the individual colors are obliquely formed in the moving direction of the intermediate transfer belt 80. Therefore, a sensing zone changes in accordance with the position of the sensor 201 or 202 in the main scanning direction, that is, in a direction perpendicular to the moving direction of the intermediate transfer belt 80. For example, the sensing zone is shortest in sensor position #1 shown in FIG. 6A, and longest in sensor position #2. It is difficult to determine the sensor position relative to the registration detection pattern 206 in advance, due to the variation in mounting position of the sensor 201 or 202, or displacement of the registration detection pattern 206 in the main scanning direction. Accordingly, the misregistration sensing zone must be set by taking account of the longest sensing zone. Even when the sensor is in sensor position #1 shown in FIG. 6A, therefore, the density detection pattern 207 cannot be formed until the end of the sensing zone denoted by reference numeral 500.

In this embodiment, therefore, the density detection pattern 207 (a second detection pattern) is positioned on the front side of the registration detection pattern 206 (a first detection pattern) as shown in FIG. 6B. Since the edges of the density detection pattern 207 are parallel to the main scanning direction, the sensing zone is unaffected by the fluctuation in relative positions of the density detection pattern 207 and sensor 201 or 202. Accordingly, when determining the formation position of the succeeding registration detection pattern 206, the fluctuation in sensing zone of the preceding density detection pattern 207 need not be taken into account. That is, it is possible to narrow the spacing between the density detection pattern 207 and registration detection pattern 206, and shorten the total sensing zone.

Figure 7A:
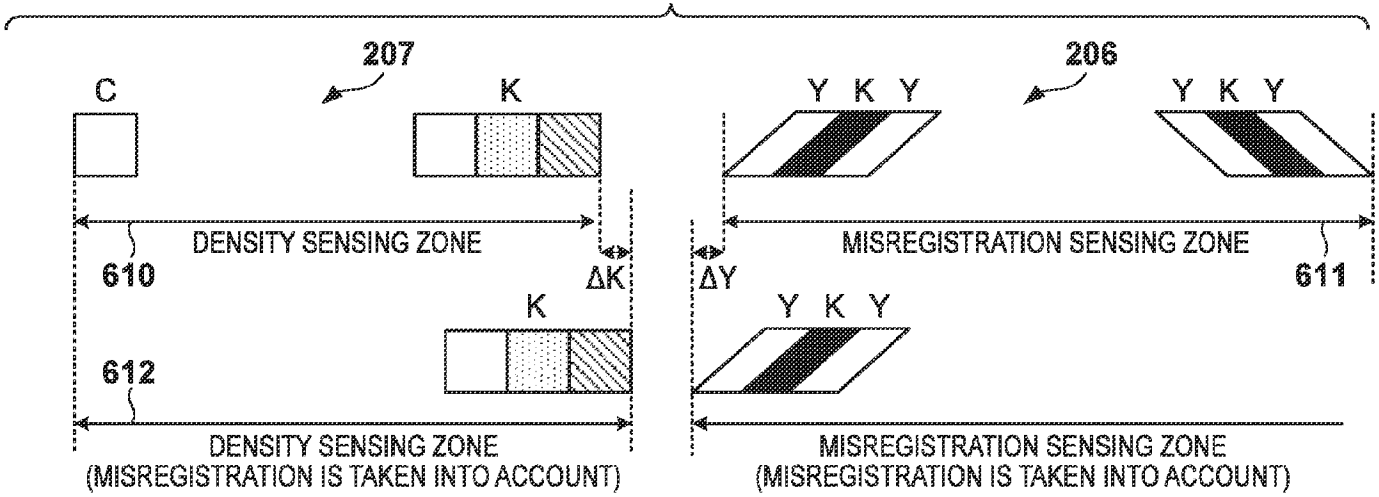
FIGS. 7A and 7B are views showing the layouts of the detection patterns according to an embodiment.

The arrangement of detection patterns unaffected by the misregistration of each color will now be explained. FIG. 7A shows an arrangement in which the first (leading) patch (cyan) and last patch (black) of the preceding density detection pattern 207 and the first patch (yellow) of the succeeding registration detection pattern 206 have different colors. Note that "first", "leading", and "last" indicate positions in the moving direction of the intermediate transfer belt 80. The upper portion of FIG. 7A shows a case in which no color misregistration occurs. In this case, the sensing zone of the density detection pattern 207 is a zone denoted by reference numeral 610, and the sensing zone of the registration detection pattern 206 is a zone denoted by reference numeral 611.

In practice, however, misregistration occurs between the first patch (cyan) and last patch (black) of the density detection pattern 207, so it is necessary to secure a sensing zone 612 taking account of this misregistration ΔK. Accordingly, the position of the registration detection pattern 206 must be shifted backward to cancel the misregistration. Similarly, misregistration may occur between the first patch (cyan) of the density detection pattern 207 and the first patch (yellow) of the registration detection pattern 206, so the registration detection pattern 206 must be positioned by taking account of misregistration ΔY.

That is, the succeeding registration detection pattern 206 must be positioned so as to be reliably detected even when the misregistrations ΔK and ΔY shown in FIG. 7A take a possible maximum value.

Figure 7B:
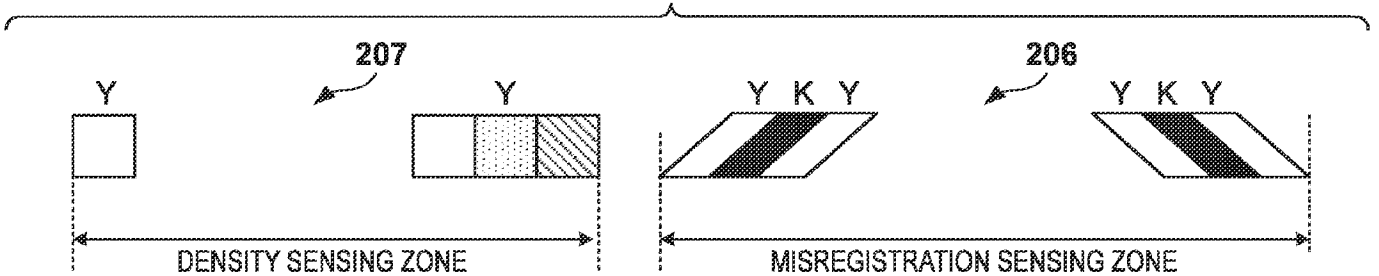

FIG. 7B shows the layout of the density detection pattern 207 and registration detection pattern 206 according to this embodiment. As shown in FIG. 7B, all of the first patch (yellow) and last patch (yellow) of the preceding density detection pattern 207 and the first and last patches (yellow) of the succeeding registration detection pattern 206 have the same color. This eliminates the fluctuation in density sensing zone, and obviates the need to take account of a fluctuation caused by a shift of the start position of the misregistration sensing zone. Consequently, it is possible to form a pattern layout unaffected by the misregistration of each color, and shorten the detection patterns by ΔK and ΔY shown in FIG. 7A.

Note that the spacing between the density detection pattern 207 and registration detection pattern 206 can be reduced by ΔY by changing only the first patch of the density detection pattern 207 shown in FIG. 7A to yellow. As a consequence, the first patch of the density detection pattern 207 and the last patch of the registration detection pattern 206 have the same color, so the color misregistration amount of the last patch of the registration detection pattern 206 need not be taken into consideration any more. This is advantageous when the registration detection pattern 206 and density detection pattern 207 cover almost the circumference of the intermediate transfer belt 80 if these patterns are continuously formed. Also, when only the last patch of the density detection pattern 207 shown in FIG. 7A is changed to yellow, it is no longer necessary to take account of the color misregistration amount of a patch, which determines the spacing between the density detection pattern 207 and registration detection pattern 206. Furthermore, when only the last patch of the density detection pattern 207 shown in FIG. 7A is changed to cyan, it is no longer necessary to ensure a margin of ΔK shown in FIG. 7A. That is, it is only necessary to adopt an arrangement in which the first patch of the density detection pattern 207 and the last patch of the density detection pattern 207 or the first or last patch of the registration detection pattern 206 have the same color, or an arrangement in which the last patch of the density detection pattern 207 and the first patch of the registration detection pattern 206 have the same color.

Figure 8:
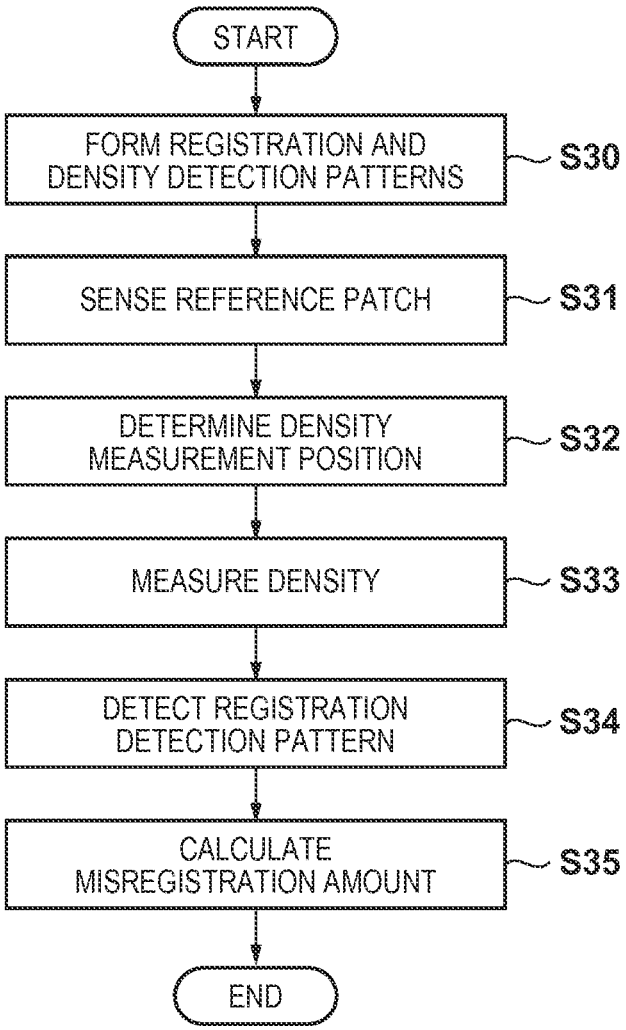
FIG. 8 is a flowchart of correction control according to an embodiment.

FIG. 8 is a flowchart of registration and density correction control according to this embodiment. When controls is started, the CPU 311 forms the density detection pattern 207 and registration detection pattern 206 on the intermediate transfer belt 80 as shown in, for example, FIG. 7B in step S30. In step S31, the CPU 311 detects the reference patches 400. In step S32, the CPU 311 determines the density measurement position of the density measurement patch 401 of each color from the detected position of the reference patch 400 of the same color. Since the distance between the reference patch 400 and density measurement patch 401 of the same color is almost constant regardless of the misregistration amount of the color, the density can accurately be measured regardless of the misregistration amount by determining the density measurement position of the density measurement patch 401 based on the reference patch 400. In step S33, the CPU 311 measures the density of the density measurement patch 401 of each color in the determined density measurement position. Subsequently, in step S34, the CPU 311 detects the formed registration detection pattern 206. In step S35, the CPU 311 calculates a misregistration amount relative to the reference color based on the detected position of the registration detection pattern 206.

The above-described arrangement can shorten the spacing between the detection patterns, and can decrease the length of the whole detection pattern. Note that in the above-mentioned embodiment, the density detection pattern 207 is formed on the front side of the registration detection pattern 206, and the first and last patches of the density detection pattern 206 and the first and last patches of the registration detection pattern 206 have the same color. However, it is also possible to form the density detection pattern 207 on the front side of the registration detection pattern 206, and arrange colors in an arbitrary order. This is so because the spacing between the detection patterns can be shortened as explained above with reference to FIG. 6B.

Furthermore, it is also possible to form the registration detection pattern 206 on the front side of the density detection pattern 207, and arrange colors in the order as explained above with reference to FIG. 7B. This is so because, as is apparent from the explanation of FIGS. 7A and 7B, the spacing between the detection patterns can be shortened regardless of the arrangement order of the detection patterns. Note that various changes based on the spirit and scope of the invention can be made, for example, it is possible to change the number of sets of the registration detection pattern 206 and density detection pattern 207 to be formed, and use a reference color other than yellow.

Second Embodiment

In the second embodiment, differences from the first embodiment will mainly be explained, and an explanation of the same features as those of the first embodiment will be omitted.

Figure 9A:
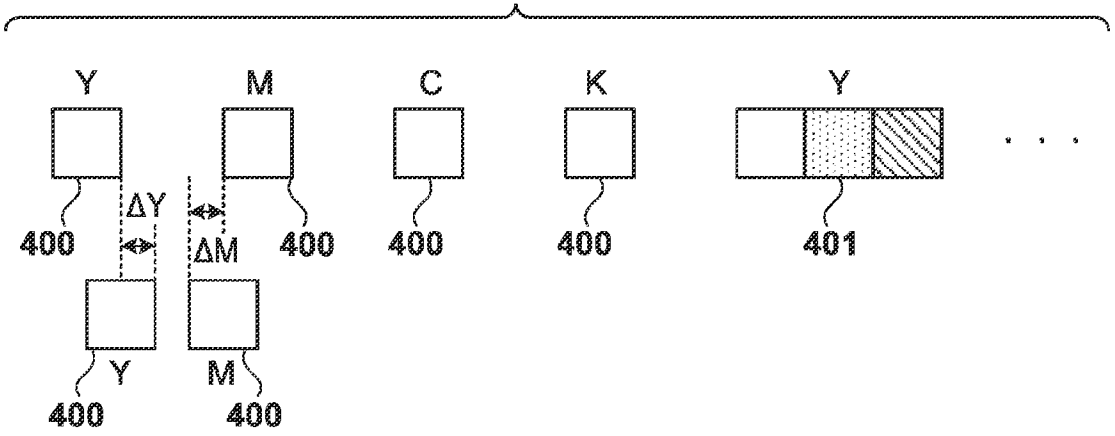
FIGS. 9A and 9B are views showing the layouts of detection patterns according to an embodiment.
Figure 9B:
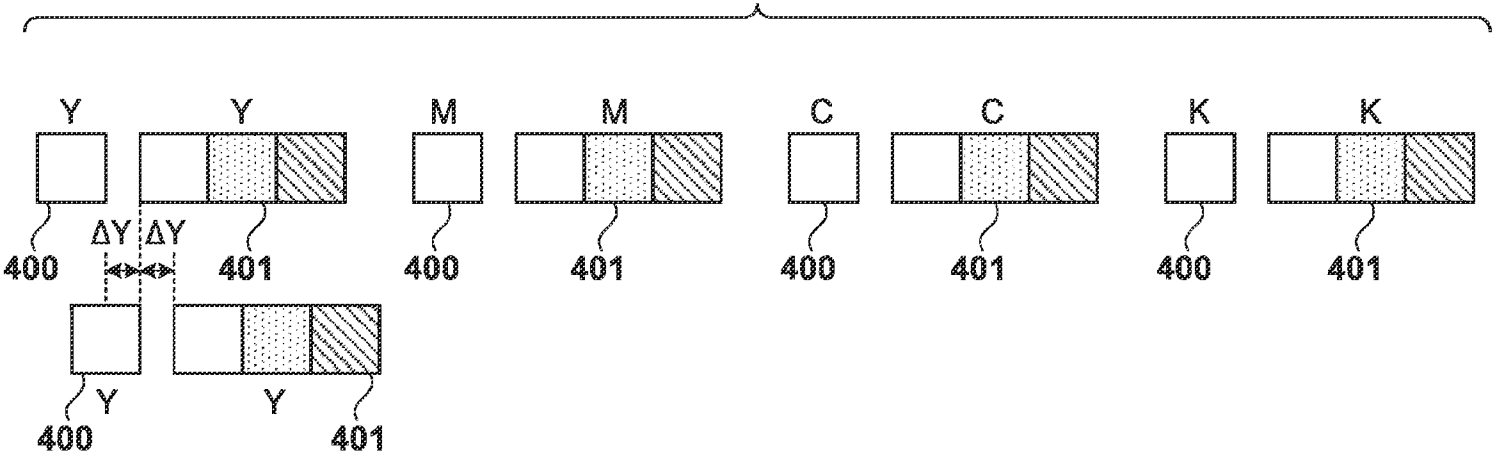

FIGS. 9A and 9B are views for explaining a density detection pattern 207 according to this embodiment. FIG. 9A shows a pattern in which reference patches 400 of individual colors are arranged first, and density measurement patches 401 are arranged after that. In this pattern, the reference patches 400 of the individual colors and the density measurement patches 401 of the individual colors are arranged such that adjacent patches have different colors, so misregistration of adjacent colors must be taken into consideration. For example, the yellow reference patch 400 and magenta reference patch 400 must be arranged so that they can be detected even when they are misregistered nearer to each other. That is, the distance between the yellow and magenta patches must be determined so that they can be detected even when misregistration ΔY of yellow and misregistration ΔM of magenta occur nearer to each other.

FIG. 9B shows a layout according to this embodiment. In this embodiment, the density measurement patches 401 of the individual colors are formed immediately after their respective corresponding reference patches 400. Accordingly, no relative misregistration occurs between the yellow reference patch 400 and yellow density measurement patch 401, so the distance between the reference patch 400 and density measurement patch 401 does not fluctuate. Consequently, the sensing zone can be shortened by a distance corresponding to the total value of ΔY and ΔM shown in FIG. 9A. This similarly applies to other colors.

The layout unaffected by the misregistration of each color has been explained above for each patch of the density detection pattern 207. Note that the reference patch 400 and density measurement patch 401 of the same color are continuously formed for all colors in the above-mentioned embodiment, but it is also possible to perform this formation for at least one color. Note also that this embodiment can also be combined with the first embodiment. The embodiments described above are exemplary embodiments. Therefore, these embodiments can variously be changed based on the spirit and scope of the invention, and do not limit the invention.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-109933, filed on May 11, 2012, which is hereby incorporated by reference herein in its entirety.

What is claimed is:

1. An image forming apparatus comprising:

an image carrier to be rotated;

a plurality of developer units configured to form developer images of a plurality of colors on the image carrier;

a detection unit configured to detect a first detection pattern for detecting relative misregistration amounts of the developer images of the plurality of colors and a second detection pattern for detecting a density of each of the developer images of the plurality of colors;

a registration correcting unit configured to correct misregistration in accordance with a detection result of the first detection pattern detected by the detection unit;

a density correcting unit configured to correct the density in accordance with a detection result of the second detection pattern detected by the detection unit; and a control unit configured to select, when forming the first detection pattern and the second detection pattern in succession in the same position in a direction perpendicular to a rotation direction of the image carrier, the same developer unit for forming a trailing edge developer image of a front side detection pattern among two detection patterns and a leading edge developer image of a rear side detection pattern among the two detection patterns in a moving direction in which the two detection patterns are moved by rotation of the image carrier to make a space between the two detection patterns shorter than a space between two patches included in the two detection patterns formed by different developing units.

2. The apparatus according to claim 1, wherein the second detection pattern has an edge in a direction perpendicular to the moving direction, and the control unit is further configured to form the first detection pattern on a rear side of the second detection pattern in the moving direction.

3. The apparatus according to claim 1, wherein the second detection pattern includes, for each of the plurality of colors, density measurement patches having a plurality of densities, and a reference patch for specifying a position of the density measurement patches, and the control unit is further configured to form a reference patch and density measurement patches in succession to the reference patch using the same developer unit.

4. The apparatus according to claim 1, wherein the first detection pattern includes patches of the plurality of colors, the second detection pattern includes density measurement patches having a plurality of densities for each of the plurality of colors, the registration correcting unit is further configured to correct misregistration by calculating a misregistration amount based on positions of the patches of the plurality of colors included in the first detection pattern detected by the detection unit, and the density correcting unit is further configured to correct the density by measuring densities of the density measurement patches based on reflection light from each of the density measurement patches included in the second detection pattern.

5. The apparatus according to claim 4, wherein the detection unit is further configured to detect the first detection pattern and the second detection pattern, which are unfixed images.

6. The apparatus according to claim 1, wherein the first detection pattern and the second detection pattern are unfixed images formed on the image carrier.

7. The apparatus according to claim 1, wherein the trailing edge developer image of the front side detection pattern among the two detection patterns and the leading edge developer image of the rear side detection pattern among the two detection patterns are formed by the same color developer.

8. The apparatus according to claim 1, wherein the image carrier is a belt.

9. The apparatus according to claim 1, wherein the plurality of developing units are further configured to form the developer images on a plurality of photosensitive members, and the developer images formed on the plurality of photosensitive members are transferred to the image carrier.

10. An image forming apparatus comprising:

an image carrier to be rotated;

a plurality of developer units configured to form developer images of a plurality of colors on the image carrier;

a detection unit configured to detect a first detection pattern for detecting relative misregistration amounts of the developer images of the plurality of colors and a second detection pattern for detecting a density of each of the developer images of the plurality of colors;

a registration correcting unit configured to correct misregistration in accordance with a detection result of the first detection pattern detected by the detection unit;

a density correcting unit configured to correct the density in accordance with a detection result of the second detection pattern detected by the detection unit; and a control unit configured to select, when forming the first detection pattern and the second detection pattern in succession in the same position in a direction perpendicular to a rotation direction of the image carrier, the same developer unit for forming a leading edge developer image of a front side detection pattern among two detection patterns and a trailing edge developer image of the front side detection pattern among the two detection patterns in a moving direction in which the two detection patterns are moved by rotation of the image carrier to make a space between the two detection patterns shorter than a space between two patches included in the two detection patterns formed by different developing units.

11. The apparatus according to claim 10, wherein the leading edge developer image of the front side detection pattern among the two detection patterns and the trailing edge developer image of the front side detection pattern among the two detection patterns are formed by the same color developer.

12. An image forming apparatus comprising:

an image carrier to be rotated;

a plurality of developer units configured to form developer images of a plurality of colors on the image carrier;

a detection unit configured to detect a first detection pattern for detecting relative misregistration amounts of the developer images of the plurality of colors and a second detection pattern for detecting a density of each of the developer images of the plurality of colors;

a registration correcting unit configured to correct misregistration in accordance with a detection result of the first detection pattern detected by the detection unit;

a density correcting unit configured to correct the density in accordance with a detection result of the second detection pattern detected by the detection unit; and a control unit configured to select, when forming the first detection pattern and the second detection pattern in succession in the same position in a direction perpendicular to a rotation direction of the image carrier, the same developer unit for forming a leading edge developer image of a front side detection pattern among two detection patterns and a leading edge developer image of a rear side detection pattern among the two detection patterns in a moving direction in which the two detection patterns are moved by rotation of the image carrier to make a space between the two detection patterns shorter than a space between two patches included in the two detection patterns formed by different developing units.

13. The apparatus according to claim 12, wherein the leading edge developer image of the front side detection pattern among the two detection patterns and the leading edge developer image of the rear side detection pattern among the two detection patterns are formed by the same color developer.

14. An image forming apparatus comprising:

an image carrier to be rotated;

a plurality of developer units configured to form developer images of a plurality of colors on the image carrier;

a detection unit configured to detect a first detection pattern for detecting relative misregistration amounts of the developer images of the plurality of colors and a second detection pattern for detecting a density of each of the developer images of the plurality of colors;

a registration correcting unit configured to correct misregistration in accordance with a detection result of the first detection pattern detected by the detection unit;

a density correcting unit configured to correct the density in accordance with a detection result of the second detection pattern detected by the detection unit; and a control unit configured to select, when forming the first detection pattern and the second detection pattern in succession in the same position in a direction perpendicular to a rotation direction of the image carrier, the same developer unit for forming a trailing edge developer image of a front side detection pattern among two detection patterns and a leading edge developer image of a rear side detection pattern among the two detection patterns in a moving direction in which the two detection patterns are moved by rotation of the image carrier to make a space between the two detection patterns shorter than a space between the two detection patterns when selecting different developing units for forming the trailing edge developer image of the front side detection pattern and the leading edge developer image of the rear side detection pattern.

15. An image forming apparatus comprising:

an image carrier to be rotated;

a plurality of developer units configured to form developer images of a plurality of colors on the image carrier;

a detection unit configured to detect a first detection pattern for detecting relative misregistration amounts of the developer images of the plurality of colors and a second detection pattern for detecting a density of each of the developer images of the plurality of colors;

a registration correcting unit configured to correct misregistration in accordance with a detection result of the first detection pattern detected by the detection unit;

a density correcting unit configured to correct the density in accordance with a detection result of the second detection pattern detected by the detection unit; and a control unit configured to select, when forming the first detection pattern and the second detection pattern in succession in the same position in a direction perpendicular to a rotation direction of the image carrier, the same developer unit for forming a leading edge developer image of a front side detection pattern among two detection patterns and a trailing edge developer image of the front side detection pattern among the two detection patterns in a moving direction in which the two detection patterns are moved by rotation of the image carrier to make a space between the two detection patterns shorter than a space between the two detection patterns when selecting different developing units for forming the leading edge developer image of the front side detection pattern and the trailing edge developer image of the front side detection pattern.

16. An image forming apparatus comprising:

an image carrier to be rotated;

a plurality of developer units configured to form developer images of a plurality of colors on the image carrier;

a detection unit configured to detect a first detection pattern for detecting relative misregistration amounts of the developer images of the plurality of colors and a second detection pattern for detecting a density of each of the developer images of the plurality of colors;

a registration correcting unit configured to correct misregistration in accordance with a detection result of the first detection pattern detected by the detection unit;

a density correcting unit configured to correct the density in accordance with a detection result of the second detection pattern detected by the detection unit; and a control unit configured to select, when forming the first detection pattern and the second detection pattern in succession in the same position in a direction perpendicular to a rotation direction of the image carrier, the same developer unit for forming a leading edge developer image of a front side detection pattern among two detection patterns and a leading edge developer image of a rear side detection pattern among the two detection patterns in a moving direction in which the two detection patterns are moved by rotation of the image carrier to make a space between the two detection patterns shorter than a space between the two detection patterns when selecting different developing units for forming the leading edge developer image of the front side detection pattern and the leading edge developer image of the rear side detection pattern.

* * * * *